US007567216B2

(12) United States Patent
Takaoka et al.

(10) Patent No.: US 7,567,216 B2
(45) Date of Patent: Jul. 28, 2009

(54) ANTENNA HOLDER

(75) Inventors: Akira Takaoka, Okazaki (JP); Noriaki Okada, Chiryu (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 170 days.

(21) Appl. No.: 11/702,110

(22) Filed: Feb. 5, 2007

(65) Prior Publication Data

US 2007/0200786 A1 Aug. 30, 2007

(30) Foreign Application Priority Data

Feb. 15, 2006 (JP) ..... 2006-038500

(51) Int. Cl.
*H01Q 1/36* (2006.01)

(52) U.S. Cl. ..... 343/895; 343/702

(58) Field of Classification Search ..... 343/895, 343/702, 790, 792

See application file for complete search history.

(56) References Cited

U.S. PATENT DOCUMENTS 5,805,112 A * 9/1998 Cassel ..... 343/702
2006/0290590 A1 12/2006 Takaoka et al. ..... 343/895

FOREIGN PATENT DOCUMENTS

| | | |
|---|---|---|
| JP | 57-181112 | 5/1982 |
| JP | 07-106826 | 4/1995 |
| JP | 2003-152427 | 5/2003 |
| JP | 2005-303655 | 10/2005 |

* cited by examiner

*Primary Examiner*—Trinh V Dinh
*Assistant Examiner*—Dieu Hien T Duong
(74) *Attorney, Agent, or Firm*—Nixon & Vanderhye, PC

(57) ABSTRACT

An antenna holder for holding an antenna includes signal wiring and ground wiring being disposed on a single circuit board as either one of an external element and an internal element respectively with one end electrically coupled with a circuit on the single circuit board for serving as the external element in a spiral shape and the internal element inside of the external element at a predetermined distance. The antenna holder is provided with a spacer for keeping the predetermined distance between the external and the internal elements as well as an external tilt suppressor for suppressing a tilt of the external element from a direction being orthogonal to the circuit board.

11 Claims, 3 Drawing Sheets

ANTENNA HOLDER

CROSS REFERENCE TO RELATED APPLICATION

This application is based on and claims the benefit of priority of Japanese Patent Application No. 2006-38500 filed on Feb. 15, 2006, the disclosure of which is incorporated herein by reference.

FIELD OF THE INVENTION

The present invention relates to an antenna holder for mounting an antenna on a circuit board.

BACKGROUND INFORMATION

Radio equipment (e.g., keyless receivers) used in, for example, vehicles and dwellings uses radio waves in ranges, such as UHF and VHF bands, of relatively long wavelengths (several tens of centimeters to several meters). In the construction of such radio equipment, the physical size of the radio equipment is governed by the size of an antenna. To reduce the size of radio equipment, therefore, reduction in the size of antennas is unavoidable.

As a construction for reducing the size of an antenna, for example, Japanese patent document JP-A-2003-152427 has been disclosed. The antenna disclosed in this patent document includes an internal conductor linearly extended and an external coiled conductor closely wound at a distance from the internal conductor with the internal conductor at the center of winding. The antenna is so constructed that it resonates at a specific frequency. Thus, the antenna is provided with a relatively high gain and further small and simple construction.

In case of this construction, the internal conductor is linearly extended, which limits antenna size reduction. The following case will be taken as an example. To reduce the size of radio equipment, the outer size of an antenna is reduced in the direction orthogonal to the direction of extension of the internal conductor. In this case, it is required to lengthen at least either of the internal conductor and the external coiled conductor to ensure an electrical length for resonance. Since the internal conductor is linear, however, the height of the antenna is significantly increased.

Meanwhile, the present applicants filed an application for Japanese patent regarding a following antenna structure under application No. JP-2005-188513 (Corresponding US publication No. US2006290590). In the disclosure of the application No. JP-2005-188513, the antenna is so constructed that using two elements, one as a signal wire and the other as a ground wire, an internal element is disposed inside a spirally extended external element at a distance between them. The internal element is in such a shape that it is spirally extended in the direction of the axis of the external element. By forming the internal element in a spiral shape as mentioned above, the band can be narrowed and the gain of the antenna can be enhanced. With substantially the same antenna gain, therefore, the antenna can be reduced in physical size more than antennas having a linear internal element can.

The above-mentioned antenna is so constructed that the following is implemented: an internal element is disposed inside a spirally extended external element with a predetermined distance between them; either of the two elements is used as a signal wire and the other is used as a ground wire. This type of antennas is antennas of so-called dipole structure, and the positional relationship between the two elements is important to the performance (resonance characteristic) of the dipole antennas. For example, when the distance is varied, the resonance frequency is varied and this has influence on the radiation characteristic. Further, a component in the direction perpendicular to the circuit board also has influence to the radiation characteristic. Therefore, when the inclination of an element to the circuit board is varied, the radiation characteristic is influenced.

However, in cases where two elements are separately mounted on a circuit board so that one end of each element is electrically connected with the wiring provided on the circuit board, problems arise. It takes much time and trouble to mount them, and further it is difficult to bring the two elements into desired positional relationship when they are mounted. Even if desired positional relationship can be obtained, it is difficult to hold the antenna in the desired positional relationship because of vibration produced in a use environment (e.g., in a vehicle-mounted environment).

SUMMARY OF THE INVENTION

In view of the above-described and other problems, the present disclosure provides an antenna holder that makes it possible to maintain the performance of an antenna and enhance the easiness of mounting it on a circuit board with respect to antennas of such construction that an internal element is disposed inside a spirally extended external element at a distance between them.

In an aspect of the present disclosure, the antenna holder includes a spacer for maintaining the predetermined distance between the external element and the internal element and an external tilt suppressor for suppressing a tilt of the external element from a direction being orthogonal to the circuit board. The antenna holder of interest in the present disclosure holds, for example, an antenna that includes signal wiring and ground wiring being disposed on a single circuit board as either one of an external element and an internal element respectively with one end electrically coupled with a circuit on the single circuit board for serving as the external element in a spiral shape and the internal element inside of the external element at a predetermined distance. In this manner, the antenna holder can hold the antenna with the distance between the two elements kept at a predetermined length when it holds the antenna in the course of installation on the circuit board and thereafter. Further, the antenna holder can maintain the distance at the predetermined length and can prevent the antenna to be out of a predetermined position even when the antenna is exposed to disturbance such as vibration or the like. Therefore, the performance of the antenna can be appropriately maintained.

In addition, a spacer and an external inclination suppressor are integrally formed with the antenna holder, thereby enabling an improved workability in terms of installation of the antenna on the circuit board.

BRIEF DESCRIPTION OF THE DRAWINGS

Other objects, features and advantages of the present invention will become more apparent from the following detailed description made with reference to the accompanying drawings, in which.

DETAILED DESCRIPTION

Hereafter, description will be given to embodiments of the invention with reference to the drawings. In the following description of embodiments, the following cases will be taken as an example: cases where of two elements that construct an antenna, the internal element disposed inside the spirally extended external element at a distance between them is in such a shape that it is spirally extended in the direction of the axis of the external element.

First Embodiment

Figure 1A:
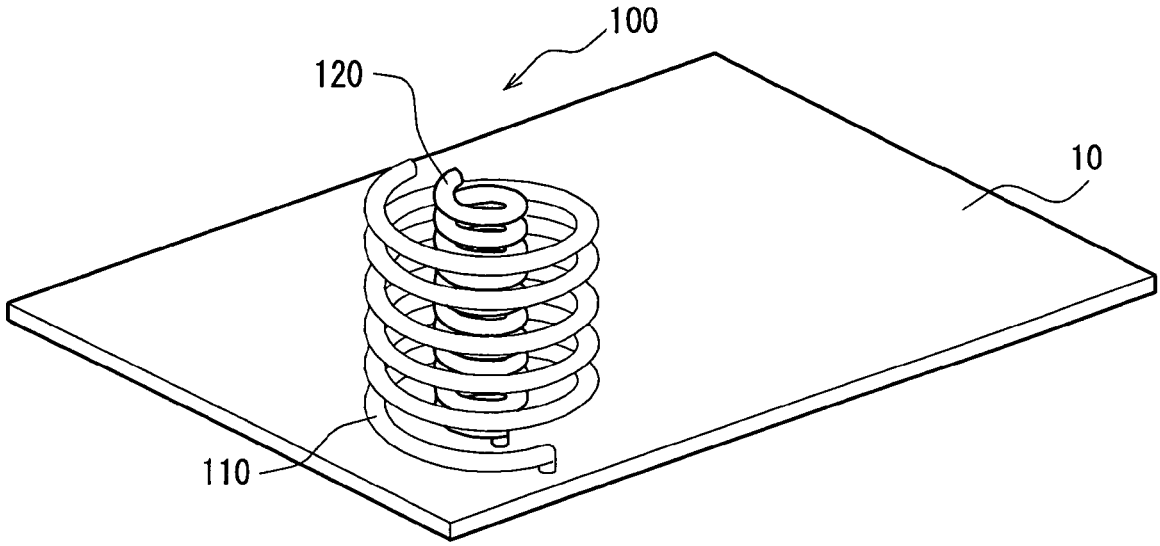
FIGS. 1A and 1B show illustrations of an antenna to be held by an antenna holder described in the present disclosure.
Figure 1B:
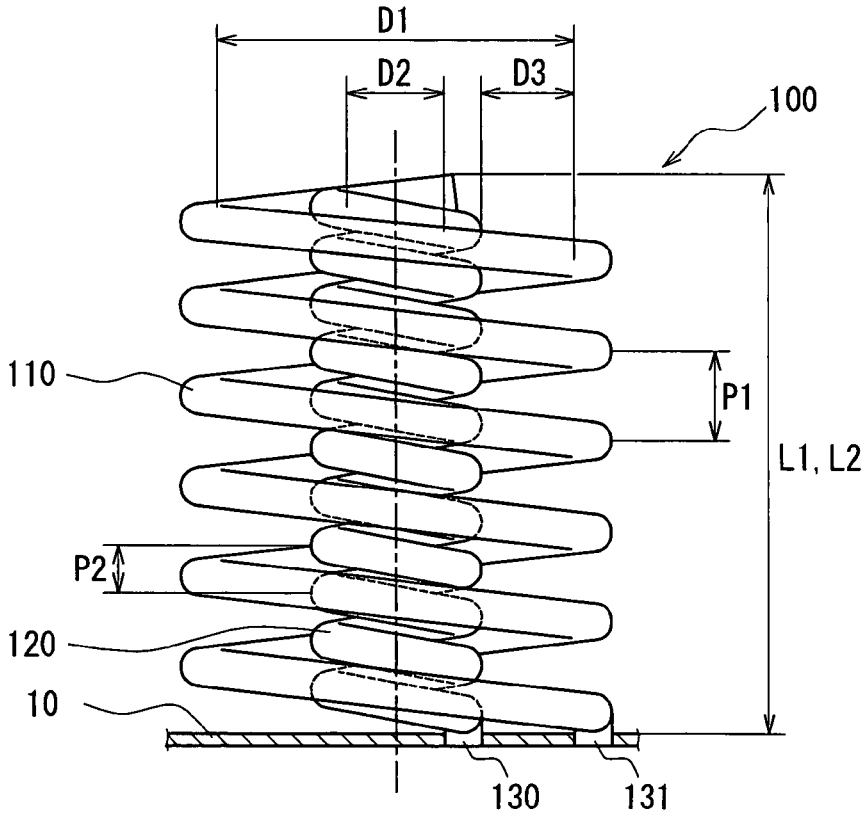

FIGS. 1A and 1B are drawings illustrating a schematic configuration of an antenna held by an antenna holder in this embodiment. FIG. 1A is a perspective view, and FIG. 1B is a side view. FIGS. 1A and 1B show the antenna as is not held by an antenna holder in the present embodiment and is mounted on a circuit board.

With such a construction that radio waves in ranges, such as UHF and VHF bands, of relatively long wavelengths (several tens of centimeters to several meters) are used as in radio equipment (e.g. keyless receivers) used in vehicles, dwelling, or the like, the physical size of the radio equipment is governed by the size of antennas. An antenna 100 shown in FIGS. 1A and 1B is so constructed that using two elements, one as a signal wire and the other as a ground wire, an internal element 120 is disposed inside the spirally extended external element 110 at a distance between them. The internal element 120 is formed in such a shape that it is spirally extended in the direction of the axis of an external element 110. By forming the internal element 120 in a spiral shape as mentioned above, the band can be narrowed and the gain of the antenna can be enhanced. With substantially the same antenna gain, therefore, the antenna can be reduced in physical size more than the antenna 100 having a liner internal element 120. In this manner, the physical size of radio equipment can be reduced. Refer to Japanese patent application No. JP-2005-188513 for technical detail of the size reduction.

In an antenna 100 of so-called dipole structure in which an internal element 120 is disposed inside a spirally extended external element 110 at a distance between them as illustrated in FIGS. 1A and 1B, the positional relation between the two elements 110, 120 is indispensable to the performance (resonance characteristic) of the antenna 100. For example, when a distance D3 between the opposite areas of the two elements 110, 120 is varied, the capacitance of a capacitor formed between the opposite areas of the two elements 110, 120 is varied. Therefore, the resonance frequency is varied, and the radiation characteristic is influenced. Further, a component in the direction perpendicular to a circuit board 10 contributes to the radiation characteristic. Therefore, when the inclination of an element 110, 120 in the direction perpendicular to the circuit board 10 is varied, the distance between the opposite areas of the elements 110, 120 (in the direction of height) is varied. (That is, when heights L1, L2 of an element 110, 120 from the board surface is varied, the distance between the opposite areas of the elements 110, 120 (in the direction of height) is varied.) As a result, the radiation characteristic is influenced.

In cases where an antenna 100 is directly mounted on the circuit board 10 provided with an amplifier circuit or the like, the measures illustrated in FIGS. 1A and 1B, for example, are taken. That is, ends of the two elements 110, 120 on one side are inserted into through holes formed in the circuit board 10, and electrically connected with wirings (lands), not shown, provided on the back surface opposite the surface of the circuit board 10 where the antenna is disposed through solder. Therefore, the two elements 110, 120 must be individually mounted on the circuit board 10, and it is difficult to bring the two elements 110, 120 into desired positional relation when they are mounted. (That is, it is difficult to set the distance D3 to a predetermined value and to ensure the perpendicularity of (the central axis of) each of the elements 110, 120 to the circuit board 10.) Especially, since the two elements 110, 120 are both spiral, it is difficult to bring them into desired positional relation. In FIG. 1B, numeral 130 denotes a feeding point, or contact with wiring, at an end of the internal element 120, and numeral 131 denotes a ground point, or contact with wiring, at an end of the external element 110. Actually, the feeding point 130 and the ground point 131 are periodically switched by a high-frequency current passed through both the elements 110, 120. The drawings show the numerals as are fixed for the sake of convenience.

Each element 110, 120 is fixed on the circuit board 10 only at one end thereof (feeding point 130, ground point 131). Therefore, even if desired positional relation is obtained when they are mounted, the elements 110, 120 are prone to have runout because of vibration produced in a use environment (e.g. in a vehicle-mounted environment). That is, it is difficult to hold the two elements 110, 120 in desired positional relation in a use environment.

Since the two elements 110, 120 must be individually mounted on the circuit board 10, a number of man-hours required for mounting is increased.

Figure 2:
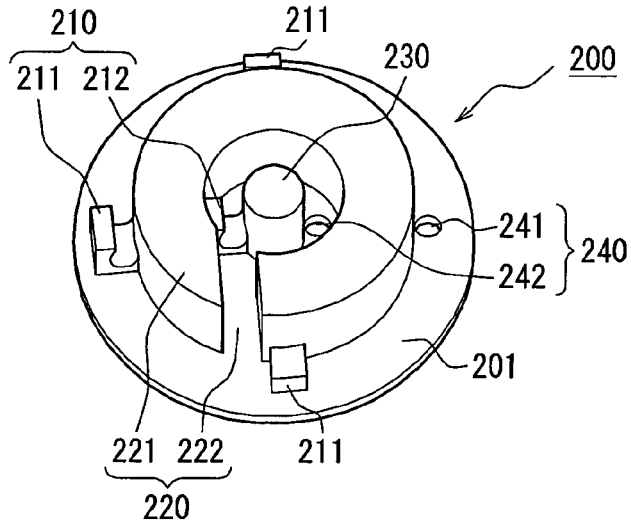
FIG. 2 shows a perspective view of the antenna holder in a first embodiment of the present disclosure.
Figure 3A:
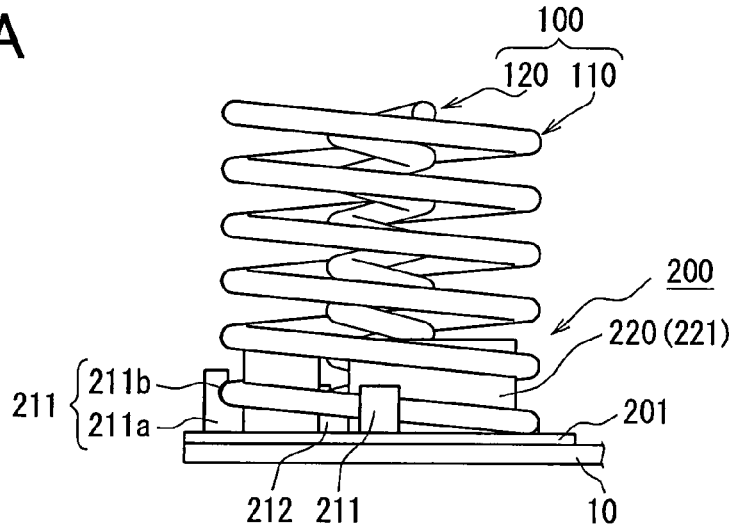
FIGS. 3A and 3B show illustrations of the antenna holder that holds the antenna in an installation state on an antenna circuit board.

Meanwhile, an antenna holder in this embodiment brings the following advantage when an antenna 100 so constructed that an internal element 120 is disposed inside a spirally extended external element 110 at a distance between them is mounted on a circuit board 10: the performance of the antenna 100 is maintained, and the easiness of mounting it on the circuit board 10 is enhanced. FIG. 2 is a perspective view illustrating the schematic configuration of an antenna holder in this embodiment. FIGS. 3A and 3A are drawings illustrating a structure in which an antenna 100 is mounted on a circuit board 10. FIG. 3A is a side view, and FIG. 3B is a sectional view.

The antenna 100 held by the antenna holder in this embodiment is an antenna 100 so constructed as illustrated in FIGS. 1A and 1B. More specific description will be given. An external element 110 and an internal element 120 are both constructed using a wire 1.2 mm in diameter. With the height from the board surface set to a predetermined value L1 (=L2), the external element and the internal element are wound as follows. The external element 10 is plurally wound (e.g. six turns) with a predetermined inside diameter D1 (e.g. 14 mm) and a predetermined pitch P1 (e.g. 3 mm) so that an electrical length (half wavelength) for resonance at a predetermined frequency is ensured. The internal element 120 is also plurally wound (e.g. nine turns) with a predetermined inside diameter D2 (e.g., 1.5 mm) smaller than D1 and a predetermined pitch P2 (e.g., 1.3 mm).

Figure 3B:
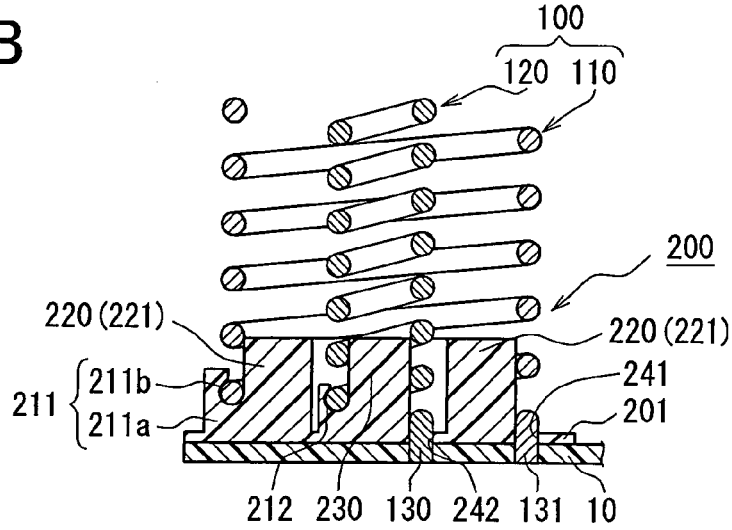

As illustrated in FIG. 2 and FIGS. 3A and 3B, an antenna holder 200 includes at least the following: a distance maintaining section 210 that keeps the opposition distance D3 between the external element 110 and the internal element 120 at a predetermined value; and an external inclination suppressing section 220 that suppresses the inclination of the central axis of the external element 110 in the direction orthogonal to the surface of the circuit board 10.

Any material can be adopted as the material for constructing the antenna holder 200 as long as it is an electrical insulation material. A material whose relative dielectric constant is as small as possible (the resulting wavelength shortening effect is small) and whose dielectric dissipation factor, which has influence on the antenna performance, is small is more desirable. In this embodiment, the antenna holder is integrally molded using a synthetic resin whose relative dielectric constant is 3 or so.

The distance maintaining section 210 is constructed of an external fitting portion 211 and an internal fitting portion 212 disposed on one surface of a flat (disk shape in this embodiment) base portion 201 at a predetermined distance between them. The external fitting portion 211 is fit to part of the spiral of the external element 110, and the internal fitting portion 212 is fit to part of the spiral of the internal element 120. For example, the external fitting portion 211 is formed by providing a protruded portion 211*a* formed on the base portion 201 with a groove portion 211*b* in line with the spiral of the corresponding external element 110. The groove portion 211*b* is so formed that the width (corresponding to the diameter of the external element 110) of the opening (upper part) for inserting the external element 110 is slightly smaller than the diameter of the external element 110 as illustrated in FIG. 2 and FIG. 3B. At the same time, the groove portion is so formed that the size of its lower part communicating with the insertion opening is substantially equal to or slightly larger than the diameter of the external element 110. The groove portion 211*b* is provided at a predetermined height from the board surface according to the position in which the external element 110 should be held. For example, by applying a little stress to the external element 110, the external element 110 is fit into the groove portion 211*b*, and thus the external element 110 can be positioned at a predetermined height from the board surface.

The internal fitting portion 212 is different only in element 120 to be fit in it, and has the same construction as the external fitting portion 212. The opposition distance between the external fitting portion 211 and the internal fitting portion 212 is set to a predetermined value at which the antenna can offer a desired antenna characteristic (resonance characteristic). Therefore, when elements 110, 120 are fit to the corresponding fitting portions 211, 212, the distance D3 between the opposite areas of the external element 110 and the internal element 120 can be set to a predetermined value. Also, after the elements are fit, the distance D3 can be maintained by the fitting portions 211, 212.

In this embodiment, three external fitting portions 211 and one internal fitting portion 212 are provided. Provision of multiple fitting portions makes it possible to hold the corresponding element 110 (120) in different positions in the direction of height from the circuit board 10. This also contributes to the maintenance of perpendicularity to the circuit board 10, and the perpendicularity can also be maintained depending on disposition (the distance maintaining section 210 also functions as, for example, the external inclination suppressing section 220). However, there is no special limitation on the number of fitting portions 211, 212. With respect to each kind of fitting portion, one or more fitting portions only have to be provided. Also, the configuration of each fitting portion 211, 212 is not limited to the foregoing.

The external inclination suppressing section 220 is so constructed that the following is implemented: it is protruded from the distance maintaining section formation surface of the base portion 201; and it is in contact with the spiral inner circumferential portion or spiral outer circumferential portion of the external element 110 throughout a predetermined range in the direction orthogonal to the circuit board (the direction of height from the surface of the circuit board). In this embodiment, the external inclination suppressing section 220 is so constructed that it includes the following: an annular portion 221 that has a predetermined height from the base portion 201 and the outer circumferential surface of which is in contact with the spiral inner circumferential portion of the external element 110 (that is, the diameter of the outer circumferential surface of which is equal to the inside diameter D1 of the external element 110); and a connecting groove 222 that is provided in the annular portion 221 and connects an inner radius area in which the internal element 120 is disposed and an outer radius area in which the external element 110 is disposed. However, the external inclination suppressing section 220 may be constructed without the connecting groove 222 (with only the annular portion 221 provided).

The larger the range (contact length) of contact with the external element 110 in the direction of height is, the more the external inclination suppressing section 220 can suppress the inclination (runout) of the central axis of the external element 110 due to vibration or the like. As mentioned above, however, the relative dielectric constant of a material that constructs the antenna holder 200 has influence on the antenna performance. Specifically, depending on relative dielectric constant, the wavelength of a high-frequency current passed through the external element 110 is shortened and the resonance frequency is shifted to a low value. To return the shifted resonance frequency to a high value, it is required to cut the external element 110 to shorten its overall length. In this case, the electrical length (component perpendicular to the circuit board 10) is shortened, and this results in a degraded radiation characteristic. Therefore, it is desirable that the height of the external inclination suppressing section 220 from the base portion 201 should be ⅓ or so of the height L1 of the external element 110 from the board surface from both the viewpoints of vibration suppression and antenna performance. In this embodiment, the height of the external inclination suppressing section 220 from the base portion 201 is set to ⅓ or so of the height L1.

In addition to the above-mentioned distance maintaining section 210 and external inclination suppressing section 220, the antenna holder 200 in this embodiment includes the following: an internal inclination suppressing section 230 that suppresses the inclination of the central axis of the internal element 120 in the direction orthogonal to the surface of the circuit board 10; and a connecting position defining section 240 that defines the positional relation between the ends (feeding point 130 and ground point 131) of the two elements 110, 120 to be connected with the wirings.

The internal inclination suppressing section 230 is so formed that the following is implemented: it is protruded from the external inclination suppressing section formation surface of the base portion 201; and it is in contact with the internal element 120 throughout a predetermined range in the direction orthogonal to the circuit board 10 (the direction of height from the surface of the circuit board). In this embodiment, the internal inclination suppressing section 230 is formed in a columnar shape so that the following is implemented: it has a predetermined height from the base portion 201; and its outer circumferential surface is in contact with the spiral inner circumferential portion of the internal element 120 (that is, the diameter of its outer circumferential surface is substantially equal to the inside diameter D2 of the internal element 120). Further, the internal inclination suppressing section 230 is so formed that the center of the column that constructs it agrees with the center of the above-mentioned annular portion 221 that constructs the external inclination suppressing section 220 in the direction of the plane of the circuit board 10. That is, when the elements 110, 120 are assembled to the antenna holder 200, the central axis of the external element 110 agrees with the central axis of the internal element 120.

The internal element 120 is disposed inside the spirally extended external element 110 at a predetermined distance between them. For this reason, the internal element 120 is less prone to have an inclination (runout) in the direction orthogonal to the surface of the circuit board due to vibration or the like as compared with the external element 110. Therefore, the internal inclination suppressing section 230 is not an element indispensable to the antenna holder 200. However, provision of the internal inclination suppressing section 230 makes it possible to suppress the inclination of the internal element 120 without fail because it is in contact with the circuit board 10 only at one end (e.g., feeding point 130). In cases where the shape of the internal element 120 is spiral, an inclination (runout) is especially prone to occur as compared with linear internal elements, as described above in relation to this embodiment. Therefore, it is desirable that the antenna holder should be so constructed that it also includes the internal inclination suppressing section 230.

Also, with respect to the internal inclination suppressing section 230, the larger the range (contact length) of contact with the internal element 120 in the direction of height is, the more it can suppress the inclination (runout) of the central axis of the internal element 120 due to vibration or the like. From both the viewpoints of vibration suppression and antenna performance, however, it is desirable that the following measure should be taken as with the external inclination suppressing section 220: the height of the internal inclination suppressing section 230 from the base portion 201 is set to ⅓ or so of the height L2 of the internal element 120 from the board surface. In this embodiment, the height of the internal inclination suppressing section 230 from the base portion 201 is set to ⅓ or so of the height L2.

The connecting position defining section 240 is a section that defines the positions of one ends of the two elements 110, 120 (feeding point 130 and ground point 131) so that they are respectively connected with the corresponding wirings. In this embodiment, an external through hole 241 and an internal through hole 242 are formed in the base portion 201, and these through holes 241, 242 are taken as the connecting position defining section 240.

The following is an example of the procedure for mounting an antenna 100 on a circuit board 10 using an antenna holder 200 constructed as mentioned above. Each of the elements 110, 120 is so constructed that its predetermined area extended from the end on the side where it is mounted on the circuit board 10 is linear and the remaining area is spiral. The antenna 100 is assembled to the antenna holder 200 in advance.

First, the spiral inner circumferential portion of the internal element 120 is guided along the outer circumferential surface of the internal inclination suppressing section 230. While this is being done, the end of the internal element 120 to be connected with the wiring of the circuit board 10 as an insertion end is inserted into the internal through hole 242 formed in the base portion 201. The internal element 120 is inserted until its spiral portion is brought into contact with the surface (external inclination suppressing section formation surface) of the base portion 201. The length of the linear portion of the internal element 120, the thickness of the circuit board 10, and the thickness of the base portion 201 are preset so that the following is implemented: when the antenna is assembled to the circuit board 10 as described later with the spiral portion of the internal element in contact with the surface of the base portion 201, the end of the internal element 120 is exposed in the back surface of the circuit board 10. Thus, the end of the internal element can be connected with the wiring by solder.

Part of the spiral portion of the internal element 120 is fit to the internal fitting portion 212 by pressure arising from this inserting operation. This completes the assembling of the internal element 120 to the antenna holder 200. In this state, the spiral inner circumferential portion of the internal element 120 is in contact with the outer circumferential surface of the internal inclination suppressing section 230. Further, (the central axis of) the internal element 120 is held substantially perpendicular to the surface of the base portion 201.

Next, the spiral inner circumferential portion of the external element 110 is guided along the outer circumferential surface of the external inclination suppressing section 220. While this is being done, the end of the external element 110 to be connected with the wiring of the circuit board 10 as an insertion end is inserted into the external through hole 241 formed in the base portion 201. The external element 110 is inserted until its spiral portion is brought into contact with the surface (external inclination suppressing section formation surface) of the base portion 201. The length of the linear portion of the external element 110, the thickness of the circuit board 10, and the thickness of the base portion 201 are preset so that the following is implemented: when the antenna is assembled to the circuit board 10 as described later with the spiral portion of the external element in contact with the surface of the base portion 201, the end of the external element 110 is exposed in the back surface of the circuit board 10. Thus, the end of the external element can be connected with the wiring by solder.

Part of the spiral portion of the external element 110 is fit to the external fitting portion 211 by pressure arising from this inserting operation. This completes the assembling of the external element 110 to the antenna holder 200, that is, the assembling of the antenna 100 to the antenna holder 200. In this state, the spiral inner circumferential portion of the external element 110 is in contact with the outer circumferential surface of the external inclination suppressing section 220. Further, (the central axis of) the external element 110 is held substantially perpendicular to the surface of the base portion 201. The external element 110 is fit to the external fitting portion 211 and the internal element 120 is fit to the internal fitting portion 212, and the distance D3 between the opposite areas of the two elements 110, 120 is kept at a predetermined value.

The antenna 100 constructed of the two elements 110, 120 assembled into one by the antenna holder 200 is mounted on the circuit board 10 in whole. Specifically, the ends exposed from the base portion 201 are inserted into the corresponding through holes in the circuit board 10 until the back surface of the base portion 210 is brought into contact with the surface of the circuit board 10. When the back surface of the base portion 201 is in contact with the surface of the circuit board 10, the ends (feeding point 130, ground point 131) of the individual elements 110, 120 are exposed in the back surface of the circuit board 10 opposite the antenna holder mounting surface. The exposed ends and the wirings (lands) provided on the surface of the circuit board around the through holes are joined with each other by solder. This completes the mounting of the antenna 100 on the circuit board 10. In this mounting state, the central axes of the spirals of the two elements 110, 120 are held substantially perpendicular to the surface of the circuit board 10 by the external inclination suppressing section 220 and the internal inclination suppressing section 230. Further, the distance D3 between the opposite areas of the two elements 110, 120 is kept at a predetermined value by the external fitting portion 211 and the internal fitting portion 212.

According to the invention, as mentioned above, the following is implemented: the antenna 100 can be mounted on the circuit board 10 with the distance D3 between the two elements 110, 120 kept at a predetermined value by the external fitting portion 211 and internal fitting portion 212 that construct the distance maintaining section 210; and also after the antenna is mounted, the distance D3 can be kept at a predetermined value. Further, the antenna 100 can be mounted on the circuit board 10 so that the central axis of the external element 110 is substantially perpendicular to the surface of the circuit board, by the external inclination suppressing section 220. Also after the antenna is mounted, the perpendicularity can be maintained. Therefore, with the antenna 100 mounted on the circuit board 10, the two elements 110, 120 can be held in desired positional relation. In other words, the certain performance of the antenna can be maintained.

Further, it is possible to assemble the antenna 100 constructed of the two elements 110, 120 into one by the antenna holder 200, and to mount the assembly on the circuit board 10 in whole. In other words, the easiness of mounting the antenna 100 on the circuit board 10 can be enhanced.

In this embodiment, further, it is possible to mount the antenna 100 on the circuit board 10 so that the central axis of the internal element 120 is substantially perpendicular to the surface of the circuit board, by the internal inclination suppressing section 230. Also after the antenna is mounted, the perpendicularity can be maintained. Therefore, the certain performance of the antenna can be more reliably maintained.

In this embodiment, the positional relation between the ends to be connected with the wirings of the circuit board 10 can be reliably defined by the external through hole 241 and internal through hole 242 that construct the connecting position defining section 240. Therefore, the easiness of mounting the antenna 100 on the circuit board 10 can be further enhanced.

In the description of this embodiment, a case where the antenna holder 200 is disposed in proximity to the ends of the two elements 110, 120 to be electrically connected with the wirings of the circuit board 10 has been taken as an example. In an area closer to the joints (feeding point 130, ground point 131) between the ends of the two elements 110, 120 and the wirings provided on the circuit board 10, a more intensive current is passed through the elements 110, 120. Such an area is low in impedance and is electrically stable. That is, though the antenna holder 200 is so constructed that the inclination suppressing sections 220, 230 are in contact with the corresponding elements 110, 120 throughout a predetermined range in the direction orthogonal to the circuit board 10, the relative dielectric constant of the holder 200 has less influence on the resonance frequency. With an identical resonance frequency, therefore, the electrical length (e.g., the number of turns of the external element 110) of the elements 110, 120 can be accordingly earned, and an inductance component that contributes to radiation can be ensured.

In the description of this embodiment, a case where the base portion 201 is disposed on the circuit board 10 has been taken as an example. Therefore, when the antenna is mounted, the inclination of the elements 110, 120 can be more reliably suppressed than in such a mounting structure that the antenna holder 200 is lifted from the circuit board 10. In addition to disposing the base portion 201 on the surface of the circuit board 10 in contact, it may be secured using, for example, adhesive. Thus, it is possible to reduce the stress that acts on the joints (feeding point 130, ground point 131) between the ends of the elements 110, 120 and the wirings. That is, the reliability of connection can be enhanced.

In the description of this embodiment, a case where the inclination suppressing sections 220, 230 are so constructed that the central axis of the internal element 120 agrees with the central axis of the external element 110 has been taken as an example. When the antenna is mounted, in this case, the opposite area of the internal element 120 and that of the external element 110 are equal to each other in height in the axial direction when the internal element 120 is positioned in the center; therefore, the antenna gain can be increased. Instead, the external element 110 and the internal element 120 may be disposed with the central axis of the internal element 120 misaligned from the central axis of the external element 110 to the extent that the antenna gain is not significantly reduced. Even to this construction, the antenna holder 200 described in this embodiment can be applied.

In the description of this embodiment, a case where the internal element 120 is assembled to the antenna holder 200 before the external element 110 is assembled has been taken as an example. Instead, the internal element 120 may be assembled after the external element 110 is assembled, or they may be simultaneously assembled.

Second Embodiment

Figure 4A:
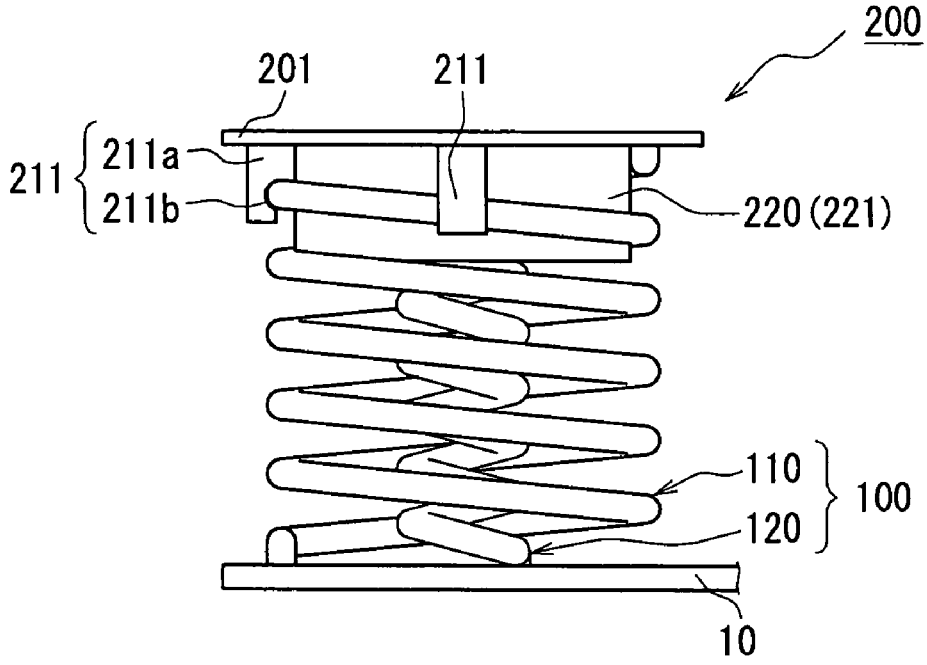
FIGS. 4A and 4B show illustrations of the antenna holder that holds the antenna in an installation state on an antenna circuit board in a second embodiment of the present disclosure.
Figure 4B:
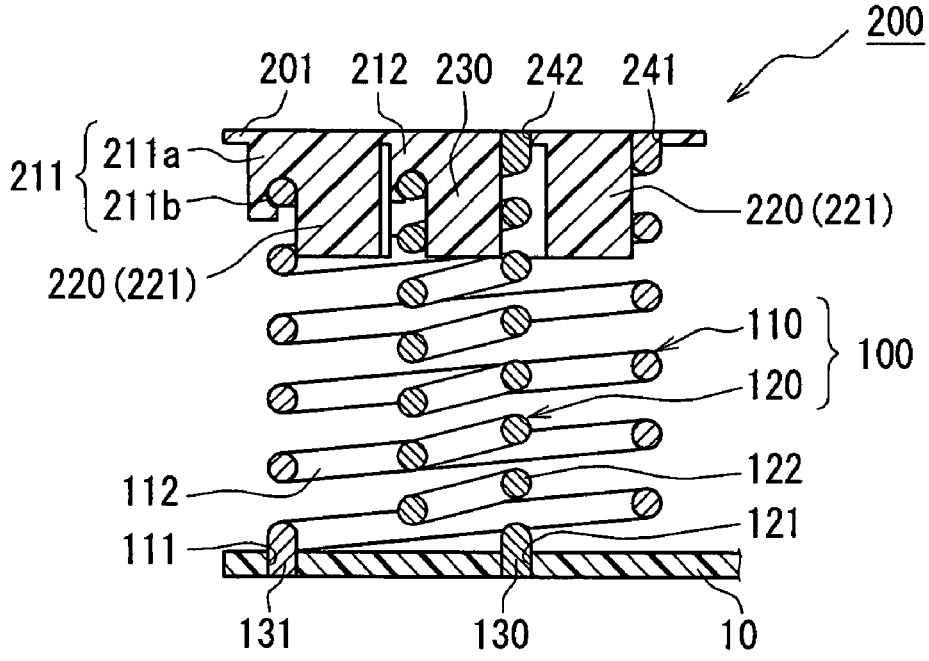

Description will be given to a second embodiment of the invention with reference to FIGS. 4A and 4B. FIGS. 4A and 4B are drawings illustrating a structure in which an antenna 100 in a second embodiment of the invention is mounted on a circuit board 10. FIG. 4A is a side view, and FIG. 4B is a sectional view.

There are many commonalities between an antenna holder 200 in the second embodiment and the antenna holder 200 described in relation to the first embodiment. Therefore, the detailed description of the commonalities will be omitted below, and description will be given mainly to differences.

In this embodiment, as illustrated in FIGS. 4A and 4B, the antenna holder 200 described in relation to the first embodiment is so disposed that it holds the ends of the two elements 110, 120 on the side where they are not connected with the wirings of the circuit board 10. That is, the antenna holder in this embodiment holds the antenna 100 in such a state that the antenna is lifted from the circuit board 10.

Unlike the two elements 110, 120 described in relation to the first embodiment, the two elements 110, 120 in this embodiment are so constructed that the following is implemented: not only their predetermined areas extended from the ends on the side where they are connected with the wirings of the circuit board 10 are linear. But also their predetermined areas extended from the ends on the side where they are not connected with the wirings are constructed as linear portions 111, 121 as illustrated in FIG. 4B. The remaining areas are constructed as spiral portions 112, 122 as illustrated in the same drawing.

The assembling of the antenna 100 to the antenna holder 20 is different from that in the first embodiment in the following: the end of each element on the side where it is not connected with the corresponding wiring is inserted as an insertion end into an external through hole 241 (internal through hole 242) formed in a base portion 201. The end of each element is inserted until its spiral portion is brought into contact with the surface (external inclination suppressing section formation surface) of the base portion 201. Then, the antenna 100 constructed of the two elements 110, 120 assembled into one by the antenna holder 200 is mounted on the circuit board 10 in whole. Specifically, the ends that are not held by the antenna holder 200, on the side where the elements are connected with the wirings are respectively inserted into corresponding through holes formed in the circuit board 10. The antenna holder is so constructed that when the spiral portions 112, 122 are inserted and brought into contact with the surface of the circuit board 10, the individual ends are exposed in the back surface of the circuit board 10. The spiral portions 112, 122 of the two elements 110, 120 are substantially perpendicular to the linear portions 111, 121 at their portions bent from the linear portions 111, 121 inserted into the through holes in the circuit board 10. Therefore, by bringing the spiral portions 112, 122 into contact with the surface of the circuit board 10, the perpendicularity of the antenna 100 to the circuit board 10 can be ensured. With the perpendicularity ensured, the ends exposed in the back surface of the circuit board 10 and the wirings (lands) provided on the surface of the circuit board around the through holes are joined with each other by solder.

Also, with the construction in this embodiment, as mentioned above, the same or similar effect as with the construction described in relation to the first embodiment can be expected.

In the description of this embodiment, a case where the two elements 110, 120 are held by the antenna holder 200 in proximity to their ends that are not connected with the wirings of the circuit board 10 has been taken as an example. Instead, the antenna holder 200 may be so constructed that the two elements 110, 120 are held in their intermediate areas.

Although the present invention has been fully described in connection with the preferred embodiment thereof with reference to the accompanying drawings, it is to be noted that various changes and modifications will become apparent to those skilled in the art.

For example, the internal element 120 may be in a linear shape or other shape instead of the spiral shape. The distance maintaining section 210 (the internal fitting portion 212) and the internal inclination suppressing section 230 may accordingly be formed. That is, the internal element 120 having the linear shape may be supported at its external surface by a part that serves as the internal inclination suppressing section 230, and the same part may serve as the external inclination suppressing section 210 by supporting the spiral inner circumferential portion of the external element 110 with its external surface.

Further, the internal inclination suppressing section 230 may be in contact with the spiral external circumferential portion of the internal element 120 instead of the spiral internal circumferential portion thereof for suppressing the runout of the internal element 120.

Furthermore, the external inclination suppressing section 220 may be in contact with the spiral external circumferential portion of the external element 110 instead of the spiral internal circumferential portion thereof for suppressing the runout of the external element 110.

Furthermore, the total electrical length of the external element 110 and the internal element 120 may be different from the half wavelength of the radio wave in use. That is, the total electrical length may be a length that can resonate with the radio wave in use.

Furthermore, the external element 110 and the internal element 120 may have different height as opposed to the case shown in the above embodiment.

Furthermore, the antenna 100 may be applied to a different apparatus such as a transmitter or the like beside being applicable to the keyless receiver.

Such changes and modifications are to be understood as being within the scope of the present invention as defined by the appended claims.

What is claimed is:

1. An antennal holder holding an antenna that includes signal wiring and ground wiring being disposed on a single circuit board as either one of an external element and an internal element, respectively, each having one end electrically coupled with a circuit on the single circuit board for serving as the external element in a spiral shape, and the internal element in a spiral shape extending inside of the external element and in an axial direction of the external element at a predetermined distance, the external element and the internal element both extending in said spiral shapes to the respective end thereof electrically coupled with the circuit, the antenna holder comprising:

a spacer for maintaining the predetermined distance between the external element and the internal element;

an external tilt suppressor for suppressing a tilt of the external element from a direction orthogonal to the circuit board;

a base having a base surface that is in parallel with a surface of the circuit board;

an external fitting portion in the spacer for fitting to a part of a spiral of the external element at the predetermined distance on the base surface; and an internal fitting portion in the spacer for fitting to the internal element, wherein the external tilt suppressor protrudes from the base surface that has the spacer disposed thereon, and the external tilt suppressor has a contact with a predetermined portion of one of an internal periphery and an external periphery of the external element in the direction being orthogonal to the circuit board.

2. The antenna holder as in claim 1, wherein the base is disposed on the circuit board, and a reverse side of a spacer formation surface for having the spacer on the base serves as a contact surface to the circuit board.

3. The antenna holder as in claim 1, wherein a position of the base is defined as one side of the internal and external elements where ends of the internal and external elements are not coupled with the circuit.

4. An antennal holder holding an antenna that includes signal wiring and ground wiring being disposed on a single circuit board as either one of an external element and an internal element, respectively, each having one end electrically coupled with a circuit on the single circuit board for serving as the external element in a spiral shape, and the internal element in a spiral shape extending inside of the external element and in an axial direction of the external element at a predetermined distance, the external element and the internal element both extending in said spiral shapes to the respective end thereof electrically coupled with the circuit, the antenna holder comprising:

a spacer for maintaining the predetermined distance between the external element and the internal element;

an external tilt suppressor for suppressing a tilt of the external element from a direction orthogonal to the circuit board;

an internal tilt suppressor for suppressing a tilt of the internal element from the direction being orthogonal to the circuit board;

a base having a base surface that is in parallel with a surface of the circuit board;

an external fitting portion in the spacer for fitting to a part of a spiral of the external element at the predetermined distance on the base surface; and an internal fitting portion in the spacer for fitting to the internal element, wherein the external tilt suppressor protrudes from the base surface that has the spacer disposed thereon, the external tilt suppressor is in contact with a predetermined area of one of an internal periphery and an external periphery of the external element in the direction being orthogonal to the circuit board, the internal tilt suppressor protrudes from the base surface that has the external tilt suppressor disposed thereon, and the internal tilt suppressor is in contact with a predetermined area of the internal element in the direction being orthogonal to the circuit board.

5. An antenna holder holding an antenna that includes signal wiring and ground wiring being disposed on a single circuit board as either one of an external element and an internal element, respectively, each having one end electrically coupled with a circuit on the single circuit board for serving as the external element in a spiral shape, and the internal element in a spiral shape extending inside of the external element and in an axial direction of the external element as a predetermined distance, the external element and the internal element both extending in said spiral shapes to the respective end thereof electrically coupled with the circuit, the antenna holder comprising:

a spacer for maintaining the predetermined distance between the external element and the internal element;

an external tilt suppressor for suppressing a tilt of the external element from a direction orthogonal to the circuit board;

a position marker for defining a relationship between respective ends of the external element and the internal element to be coupled with the circuit;

a base having a base surface that is in parallel with a surface of the circuit board;

an external fitting portion in the spacer for fitting to a part of a spiral of the external element at the predetermined distance on the base surface; and an internal fitting portion in the spacer for fitting to the internal element, wherein the external tilt suppressor protrudes from the base surface that has the spacer disposed thereon, the external tilt suppressor is in contact with a predetermined portion of one of an internal periphery and an external periphery of the external element in the direction being orthogonal to the circuit board, and the position marker is provided as a through hold formed in the base according to the relationship between respective ends of the external element and the internal element.

6. The antenna holder as in claim 5, wherein the internal tilt suppressor protrudes from the base surface that has the external tilt suppressor disposed thereon, the internal tilt suppressor is in contact with a predetermined portion of the internal element in the direction being orthogonal to the circuit board.

7. An antenna holder holding an antenna that includes signal wiring and ground wiring being disposed on a single circuit board as either one of an external element and an internal element, respectively, each having one end electrically coupled with a circuit on the single circuit board for serving as the external element in a spiral shaper and the internal element inside of the external element at a predetermined distance, the antenna holder comprising:

a spacer for maintaining the predetermined distance between the external element and the internal element;

an external tilt suppressor for suppressing a tilt of the external element from a direction being orthogonal to the circuit board;

a base having a base surface that is in parallel with a surface of the circuit board;

an external fitting portion in the spacer for fitting to a part of a spiral of the external element at the predetermined distance on the base surface; and an internal fitting portion in the spacer for fitting to the internal element, wherein the external tilt suppressor protrudes from the base surface that has the spacer disposed thereon, and the external tilt suppressor has a contact with a predetermined portion of one of an internal periphery and an external periphery of the external element in the direction being orthogonal to the circuit board.

8. The antenna holder as in claim 7, wherein a total electrical length of the external element and the internal element corresponds to a half wavelength of a radio wave in use.

9. The antenna holder as in claim 7, wherein the external element and the internal element have substantially a same height.

10. The antenna holder as in claim 7, wherein an axis of the internal element is aligned with an axis of the external element.

11. The antenna holder as in claim 7, wherein the antenna is applied for use in a radio on a vehicle.

* * * * *